US012168547B2

(12) United States Patent
Goss

(10) Patent No.: US 12,168,547 B2
(45) Date of Patent: Dec. 17, 2024

(54) LOAD CARRIER AND METHOD

(71) Applicant: FEURER FEBRA GMBH, Brackenheim (DE)

(72) Inventor: Oleg Goss, Eppingen (DE)

(73) Assignee: FEURER FEBRA GMBH, Brackenheim (DE)

( * ) Notice: Subject to any disclaimer, the term of this patent is extended or adjusted under 35 U.S.C. 154(b) by 12 days.

(21) Appl. No.: 18/033,135

(22) PCT Filed: Oct. 18, 2021

(86) PCT No.: PCT/EP2021/078765
§ 371 (c)(1),
(2) Date: Apr. 21, 2023

(87) PCT Pub. No.: WO2022/084227
PCT Pub. Date: Apr. 28, 2022

(65) Prior Publication Data

US 2023/0391508 A1 Dec. 7, 2023

(30) Foreign Application Priority Data

Oct. 22, 2020 (DE) ..... 102020127889.6

(51) Int. Cl.
*B65D 25/10* (2006.01)
*B22F 3/14* (2006.01)

(52) U.S. Cl.
CPC ..... *B65D 25/107* (2013.01); *B22F 3/14* (2013.01)

(58) Field of Classification Search
CPC ..... B65D 25/10; B65D 25/102; B65D 25/107
(Continued)

(56) References Cited

U.S. PATENT DOCUMENTS

2006/0013647 A1 1/2006 Farley et al.
2007/0158282 A1 7/2007 Howard
(Continued)

FOREIGN PATENT DOCUMENTS

DE 19931269 A1 9/2000
DE 102006046077 B3 1/2008
(Continued)

OTHER PUBLICATIONS

English Translation of PCT International Preliminary Report and Written Opinion in PCT/EP2021/078765 mailed May 4, 2023.
(Continued)

*Primary Examiner* — Jacob K Ackun
(74) *Attorney, Agent, or Firm* — Barnes & Thornburg LLP

(57) ABSTRACT

The invention relates to a charge carrier (10) with a main body (12) made of a particle foam, in particular of expanded polypropylene (EPP) or of expanded polyurethane (EPU), and with at least one functional element (20), which consists of a material that is harder than the particle foam. According to the invention, it is provided that the main body (12) has a depression (26) for each functional element (20), the depression being assigned to the respective element and having extending from it, in two mutually facing boundary surfaces (36), a respective receiving channel (38) which is bounded on three sides by the main body (12) and is open towards the depression (26), and that each functional element (20) has an anchoring portion (28), which protrudes into the depression (26) assigned to it and has retaining ribs (32) which project away from one another and each engage in one of the receiving channels.

15 Claims, 4 Drawing Sheets

Figure 1A:
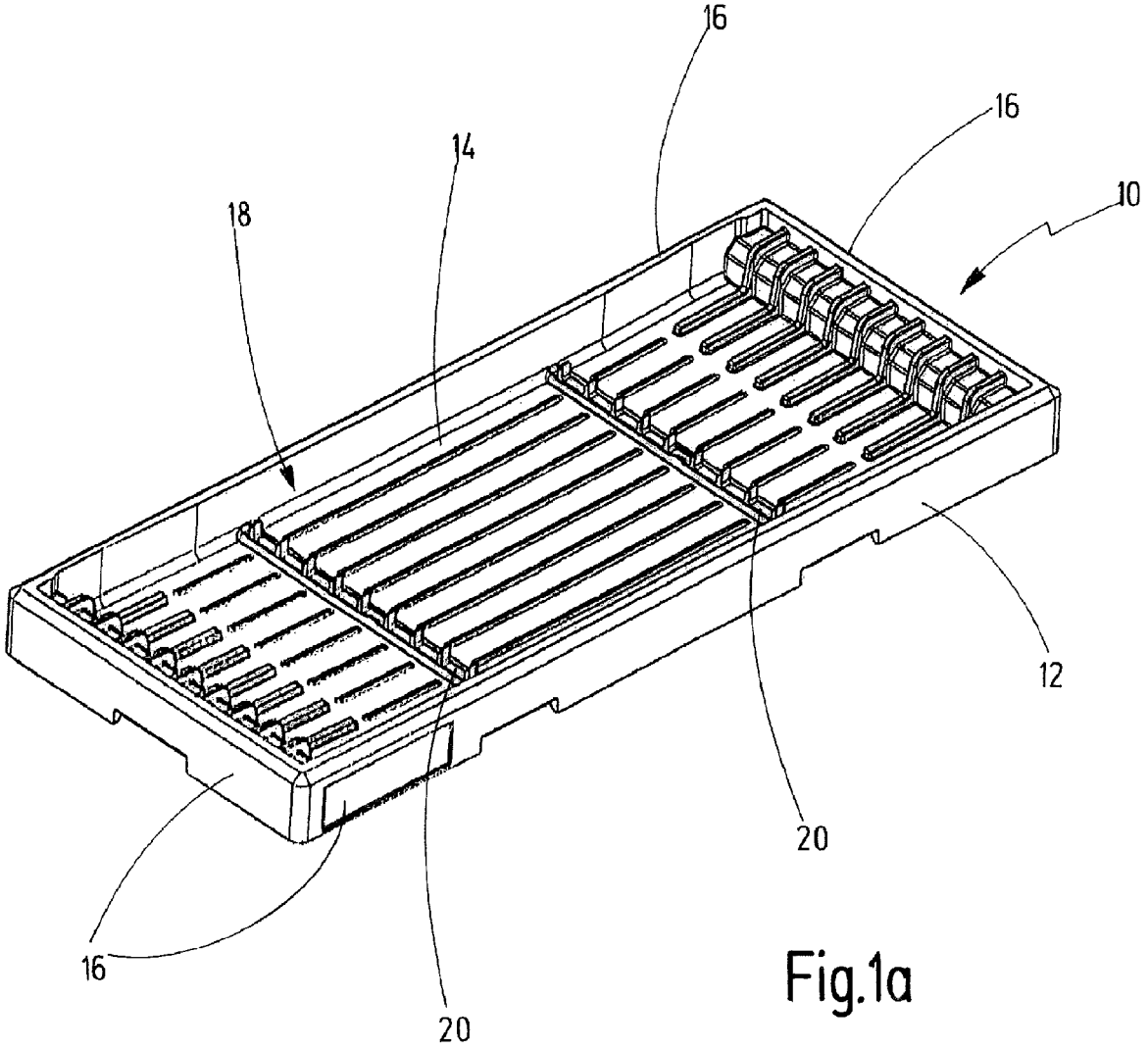

(58) Field of Classification Search
USPC ..... 206/561, 565
See application file for complete search history.

(56) References Cited

U.S. PATENT DOCUMENTS

| | | | | |
|---|---|---|---|---|
| 2008/0099358 | A1* | 5/2008 | Bell | B65D 25/107 206/319 |
| 2016/0089773 | A1* | 3/2016 | Lin | B65D 25/10 206/372 |
| 2020/0020549 | A1* | 1/2020 | Ogawa | F16K 15/026 |
| 2023/0264881 | A1* | 8/2023 | Pifer | B65D 25/107 206/586 |
| 2023/0339652 | A1* | 10/2023 | Yun | B65D 85/30 |

FOREIGN PATENT DOCUMENTS

| | | | |
|---|---|---|---|
| DE | 102011103359 | A1 | 11/2012 |
| DE | 102014000021 | A1 | 7/2015 |
| DE | 102016010378 | A1 | 3/2018 |
| JP | H06298288 | A | 10/1994 |
| JP | 200957101 | A | 3/2009 |
| JP | 3210846 | U | 6/2017 |

OTHER PUBLICATIONS

Office Action for copending European Application No. EP4214138, dated May 17, 2024.
Search Report for copending German Application No. 102020127889.6, dated Jul. 1, 2021.

* cited by examiner

LOAD CARRIER AND METHOD

CROSS-REFERENCE TO RELATED APPLICATIONS

This is a national stage entry of International Patent Application No. PCT/EP2021/078765, filed Oct. 18, 2021, which claims the benefit of and priority to German Patent Application No. 10 2020 127 889.6, filed Oct. 22, 2020, the disclosures of which are expressly incorporated herein by reference in their entireties.

The invention relates to a load carrier with a main body made from a particle foam in accordance with the preamble of claim 1.

Load carriers of this type are as a rule used for transporting piece goods. The main body made from particle foam is very soft here, with the result that sensitive piece goods such as, for example, components for the automotive industry are not damaged upon contact with the main body. The load carriers are fitted with functional elements made from a material which is harder than the particle foam. In particular, holding rails for the piece goods are used as functional elements, which holding rails hold the piece goods in position and secure them against slipping. Functional elements of this type have to be fixed on the main body, adhesive or other additional fastening means such as bolts usually being used. This is often perceived to be laborious.

It is therefore an object of the invention to develop a load carrier of the type mentioned at the outset in such a way that it can be produced more simply.

According to the invention, this object is achieved by way of a load carrier with the features of claim 1. Advantageous developments of the invention are the subject matter of the dependent claims.

The invention is based on the concept of simplifying the fastening of the at least one functional element to the main body by virtue of the fact that it is not fixed by way of additional fastening means such as adhesive or bolts, but rather is anchored in the main body as it were in a positively locking manner. Here, the functional element is inserted by way of its anchoring section into the depression which is assigned to it, the holding ribs being inserted into the receiving grooves which form an undercut of the depression. When, in particular, the insertion of the at least one functional element into the associated depression of the main body takes place, when the main body which is produced by means of a sintering method by way of heat treatment is removed from the sintering mold and has not yet cooled, the insertion can be carried out with a low expenditure of force, while the functional element is fixed firmly in the main body after the latter has cooled. Here, the main body which is still soft can be at least partially elastically deformed in the region of the depression which is assigned to the functional element when the functional element is introduced by way of its anchoring section into the depression. In particular, in the region of its anchoring section, the functional element can have a width which would be slightly greater, for example by approximately 2%, than the width of the depression if no functional element were inserted into it. The main body then bears at least in sections in a positively locking and non-positive manner against the anchoring section and holds the functional element firmly.

Each anchoring section expediently has an engagement section which is received in the associated depression and from which the holding ribs project on sides which face away from one another. It is preferred here that the holding ribs project out of the respective engagement section in each case by at least 1.5 mm, preferably by at least 2 mm. The receiving grooves likewise have to have an appropriate depth, in order to receive the holding ribs, with the result that there is a stable connection. Furthermore, it is preferred that the bounding faces of each depression bear against the engagement section of the functional element which is assigned to the depression, with the result that pulling of the holding ribs out of the receiving grooves is impeded further. In particular, each depression can be stretched by way of the functional element which is assigned to it, with deformation of the main body, with the result that there is an additional non-positive connection between the main body and the respective functional element. For example, the at least one functional element can be dimensioned in such a way that its engagement section and its holding ribs are inserted with an accurate fit into the associated depression and the receiving grooves of the main body which is removed from the sintering mold and has not yet cooled, and that the deformation of the main body results on the basis of its volume reduction when cooling to ambient temperature.

In order to facilitate the positioning of the respective functional element in the associated depression, it can be provided that each anchoring section has an notch which faces one of the bounding faces and into which a projection which projects from the relevant bounding face engages. The projection can have a smaller length in the direction of the longitudinal extent of the functional element than the notch, with the result that there is some play.

The at least one functional element expediently consists of rigid plastic. In addition, it is advantageously configured in one piece, preferably as an injection molded part. Parts of this type can be produced simply and have a high stability. The at least one functional element is typically a holding rail with a holding section for piece goods. It can also fulfill other functions, however.

It is preferred that the receiving grooves lie symmetrically opposite one another with regard to a center longitudinal plane of the depression, from which they extend, possibly with the exception of the region, in which the notch is arranged. The depth, measured from the respective bounding face, of each of the receiving grooves advantageously increases continuously up to a maximum depth. This facilitates the insertion of the respective functional element into the associated depression.

Figure 1B:
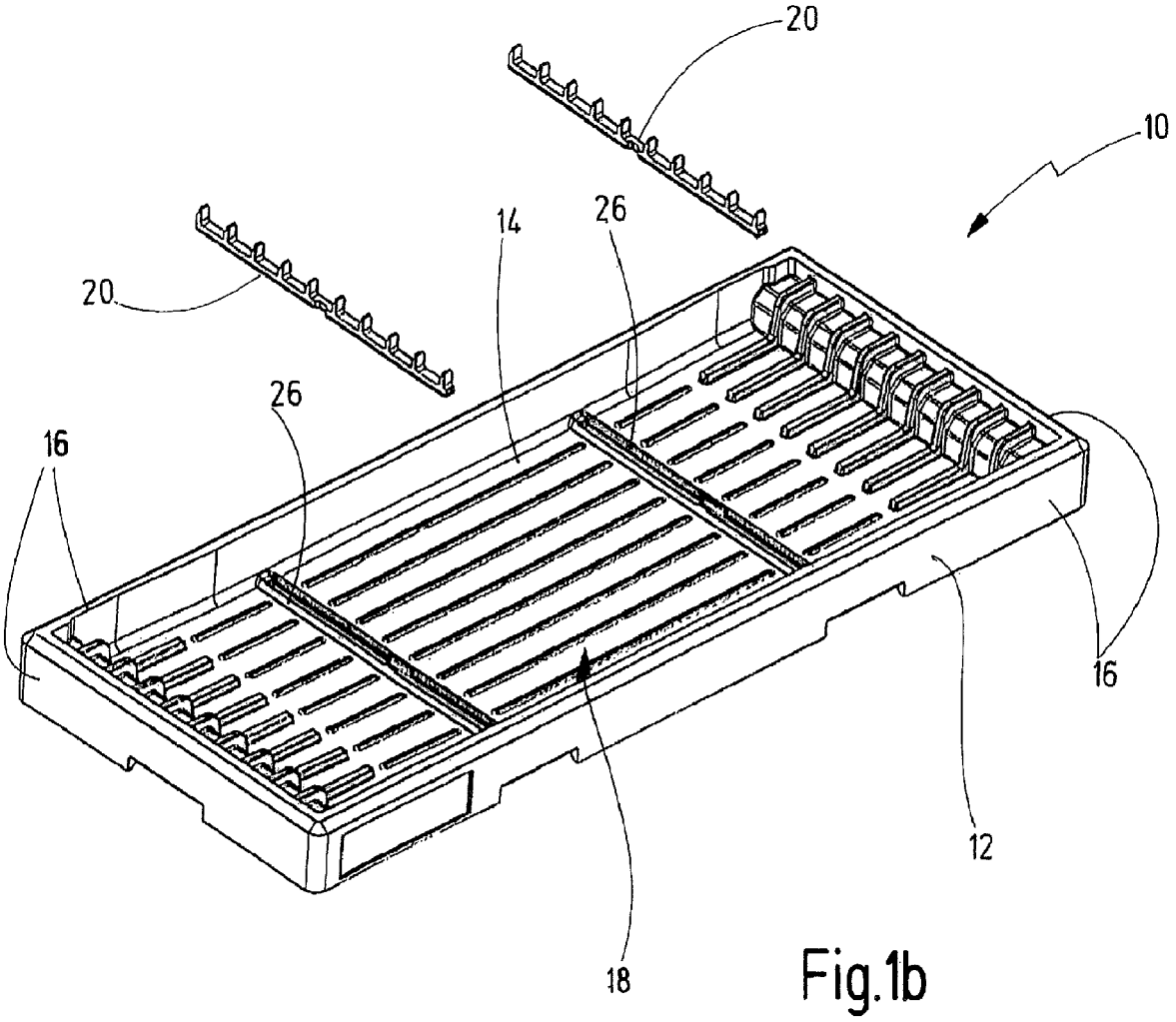
Figure 2A:
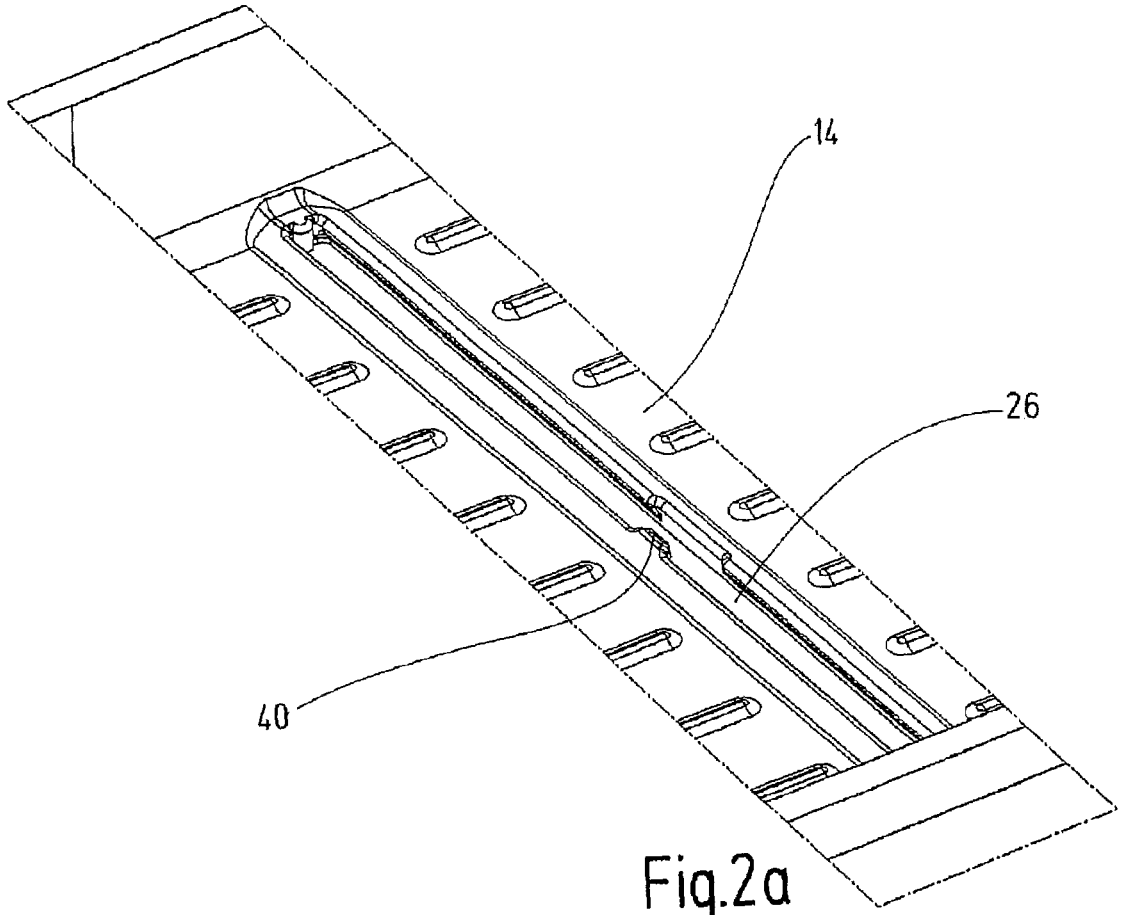
Figure 3A:
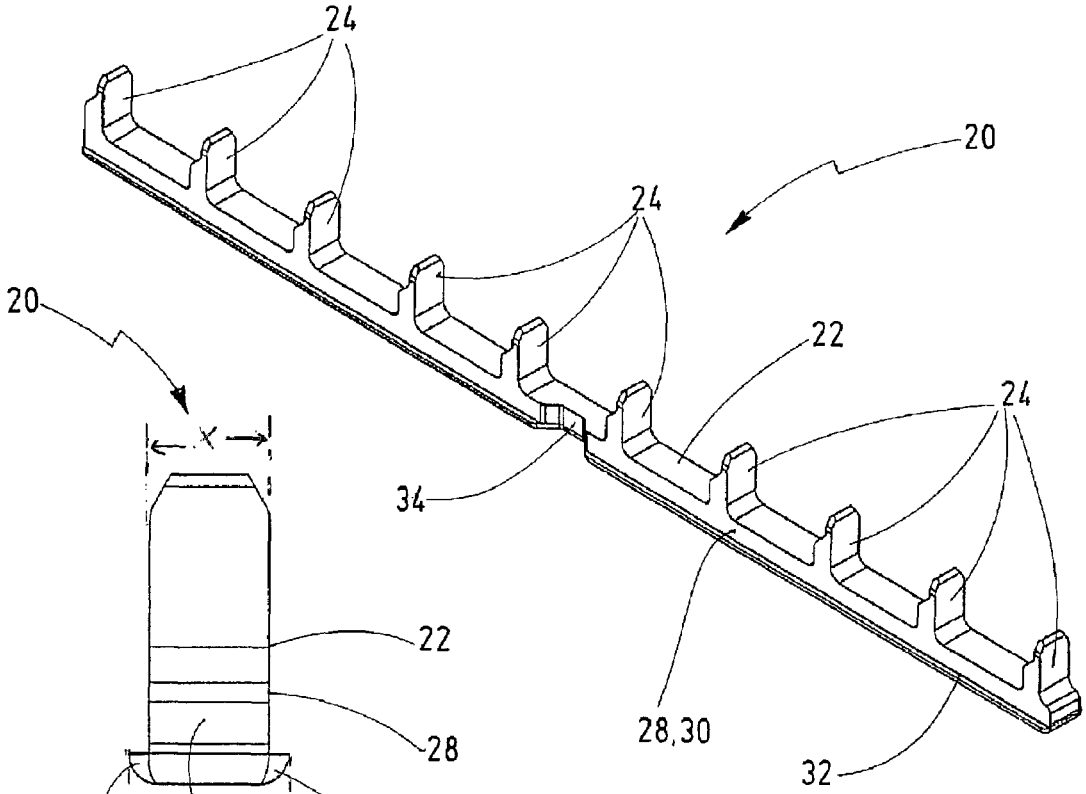
Figure 4:
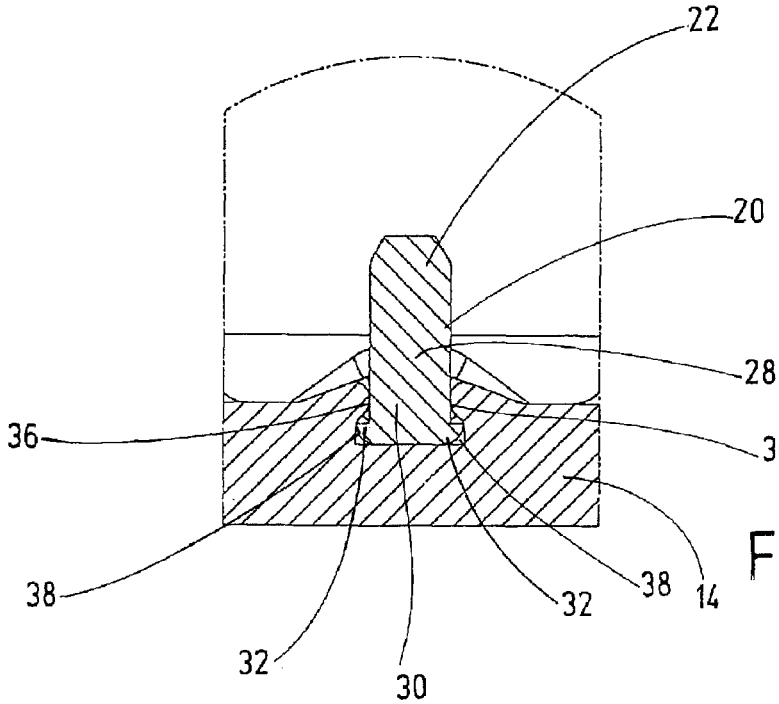

In the following text, the invention will be explained in greater detail on the basis of one exemplary embodiment which is shown diagrammatically in the drawing, in which:

FIGS. 1*a,b* show a load carrier in a perspective illustration and in an exploded illustration, FIGS. 2*a,b* show detailed illustrations of the load carrier according to FIG. 1*b* in a perspective view and in section, FIGS. 3*a,b* show a holding rail in a perspective view and in a side view, and FIG. 4 shows a detailed view of the load carrier according to FIG. 1*a* in section.

The load carrier 10 which is shown in the drawing serves to store and to transport components for the automotive industry. It has a single-piece main body 12 which is made from a particle foam and has a bottom 14 and walls 16 which stand up from the bottom 14 and border an upwardly open receiving space 18 for the components all around. Two functional elements are fixed on the bottom 14 in the form of holding rails 20 which each have a holding section 22 with upwardly standing teeth 24, between which the components can be inserted. The holding rails 20 are manufactured structurally identically as injection molded parts in one piece from a rigid plastic.

Each holding rail 20 is assigned a depression 26 in the bottom 14 of the main body, into which depression 26 an anchoring section 28 of the holding rail 20 engages. The anchoring section 28 has an engagement section 30, received in the depression, and holding ribs 32 which project from the engagement section 30 by approximately 2 mm in opposite directions to one another. One of the holding ribs 32 extends over the entire length of the holding rail 20, while the other holding rib 32 is interrupted by way of a notch 34 in the middle of the holding rail 20. From each of the depressions 26, a receiving groove 38 extends in each case in two bounding faces 36 which face one another, which receiving groove 38 is delimited on three sides by the main body 12, is open toward the depression 26, and the depth of which increases initially continuously starting from the respective bounding face 36 until it reaches a maximum depth. A projection 40 which engages into the notch 34 of the relevant holding rail 20 projects from one of the bounding faces 36 approximately in the middle of the depressions 26. As measured in the longitudinal direction of the holding rail 20, the projection 40 is shorter than the notch 34, with the result that it is received with play in the latter.

Figure 2B:
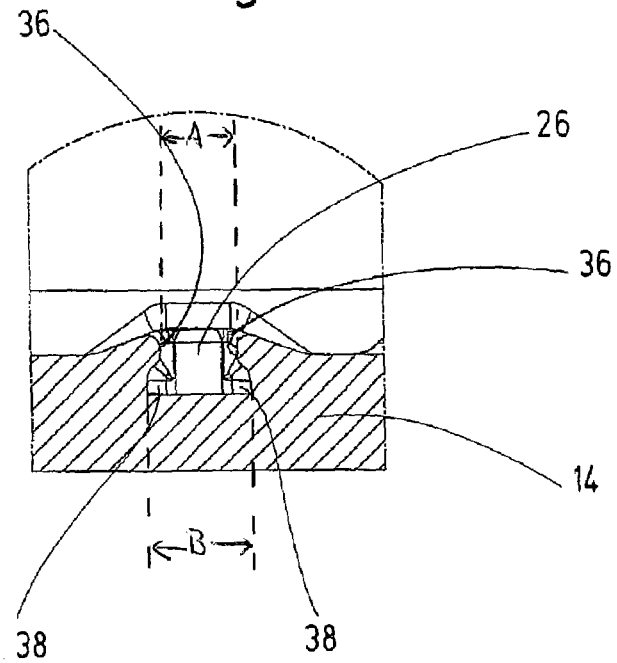
Figure 3B:
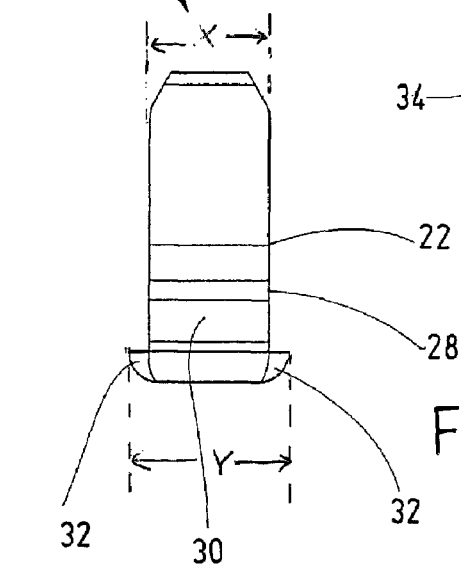

During the production of the load carrier 10, first of all the main body 12 is produced in a sintering method by way of heat treatment in a sintering mold. Before cooling to ambient temperature, the main body 12 is removed from the sintering mold, and the holding rails 20 are inserted into the depressions 26, the particle foam material which is still soft being slightly deformed elastically. During cooling to ambient temperature, it contracts, with the result that firstly the bounding faces 36 bear against the engagement sections 30, and secondly the main body 12 is under stress or is stretched in the region of the depressions 26. This is achieved by virtue of the fact that the width X (cf. FIG. 3*b*) of the engagement section 30 is greater by from 1% to 3% and preferably by 2% than the spacing A (cf. FIG. 2*b*) between the bounding faces 36 would be if no holding rail 20 were inserted into the depression 26. In addition or as an alternative, the width Y (measured in the region of the holding ribs 32) of the holding rail 20 can be greater by from 1% to 3% and preferably by 2% than the width B which the depression 26 would have in the region of the receiving grooves 38 if no holding rail 20 were inserted into it.

The following is to be noted in summary: the invention relates to a load carrier 10 with a main body 12 made from a particle foam, in particular made from expanded polypropylene (EPP) or from expanded polyurethane (EPU), and with at least one functional element 20 which consists of a material which is harder than the particle foam. It is provided according to the invention that the main body 12 has, for each functional element 20, a depression 26 which is assigned to the latter and from which in each case one receiving groove 38 which is delimited by the main body 12 on three sides and is open toward the depression 26 extends in two bounding faces 36 which face one another, and that each functional element 20 has an anchoring section 28 which protrudes into the depression 26, assigned to it, and has holding ribs 32 which engage in each case into one of the receiving grooves.

The invention claimed is:

1. A load carrier, comprising:

a main body made from a particle foam, and a functional element made of a material which is harder than the particle foam, wherein the main body defines a depression, the depression including two bounding faces which face one another and each of which extend into the main body to a respective receiving groove, each receiving groove delimited by the main body on three sides and open toward the depression, and wherein the functional element has an anchoring section which protrudes into the depression, the anchoring section including holding ribs which engage the receiving grooves.

2. The load carrier as claimed in claim 1, wherein the anchoring section of the functional element has an engagement section received in the depression and from which the holding ribs project on sides of the engagement section which face away from one another.

3. The load carrier as claimed in claim 2, wherein the holding ribs project out of the engagement section by at least 1.5 mm.

4. The load carrier as claimed in claim 2, wherein the bounding faces of the depression bear against the engagement section of the functional element.

5. The load carrier as claimed in claim 1, wherein the depression is stretched by the functional element with deformation of the main body.

6. The load carrier as claimed in claim 1, wherein the anchoring section has a notch, and the depression has a projection which projects out of one of the bounding faces and which engages the notch.

7. The load carrier as claimed in claim 6, wherein the projection has a smaller length in a longitudinal direction of the functional element than the notch.

8. The load carrier as claimed in claim 1, wherein the functional element is made of a rigid plastic.

9. The load carrier as claimed in claim 1, wherein the functional element is configured in one piece.

10. The load carrier as claimed in claim 1, wherein the functional element is a holding rail with a holding section for piece goods.

11. The load carrier as claimed in claim 1, wherein the receiving grooves lie symmetrically opposite one another with regard to a center longitudinal plane of the depression from which they extend.

12. The load carrier as claimed in claim 1, wherein a depth, measured from the respective bounding face, of each of the receiving grooves increases continuously up to a maximum depth.

13. The load carrier as claimed in claim 1, wherein the functional element comprises a plurality of functional elements, and wherein the depression comprises a plurality of depressions each extending into the main body, each of the plurality of depressions engaging a respective one of the plurality of functional elements.

14. A method for producing a load carrier as claimed in claim 1, the method comprising:

(a) heat treating the main body by sintering the main body in a sintering mold, (b) removing the main body from the sintering mold before cooling the main body to ambient temperature, and (c) after removing the main body from the sintering mold and before the cooling of the main body to ambient temperature, introducing the anchoring section of the functional element into the depression with at least partial elastic deformation of the main body in the region of the depression receiving the anchoring section of the functional element.

15. The method of claim 14, wherein the wherein the functional element comprises a plurality of functional elements, and the depression comprises a plurality of depressions each extending into the main body, and wherein (c) comprises introducing the anchoring section of each of the plurality of functional elements into a respective one of the plurality of depressions with at least partial elastic deformation of the main body in the region of each the plurality of depressions receiving the anchoring section of a respective one of the plurality of functional elements.

* * * * *